US007435096B2

(12) United States Patent
Wang et al.

(10) Patent No.: US 7,435,096 B2
(45) Date of Patent: Oct. 14, 2008

(54) RF CONNECTOR ASSEMBLY HAVING IMPROVED CONNECTING MEMBER

(75) Inventors: Chien-Chiung Wang, Tu-cheng (TW); Qing-Man Zhu, Kunshan (CN); Hong-Feng Jiang, Kunshan (CN); Lin Wu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/973,799

(22) Filed: Oct. 9, 2007

(65) Prior Publication Data

US 2008/0085614 A1 Apr. 10, 2008

(51) Int. Cl.
*H01R 12/14* (2006.01)

(52) U.S. Cl. ..... 439/63; 439/471; 439/610; 439/947

(58) Field of Classification Search ..... 439/63, 439/452, 459, 470, 471, 473, 610, 947
See application file for complete search history.

(56) References Cited

U.S. PATENT DOCUMENTS 4,360,244 A * 11/1982 Forney et al. ..... 439/581
4,799,900 A * 1/1989 Capp et al. ..... 439/585
5,112,249 A * 5/1992 Henry et al. ..... 439/581
6,439,929 B1 * 8/2002 Jenets ..... 439/610
6,811,441 B2 * 11/2004 Simpson ..... 439/610
6,817,899 B1 * 11/2004 Zerebilov ..... 439/582
6,824,392 B1 * 11/2004 Guo ..... 439/63
6,957,970 B2 * 10/2005 Weigel et al. ..... 439/320
2004/0106304 A1 * 6/2004 Lin et al. ..... 439/63
2008/0085614 A1 * 4/2008 Wang et al. ..... 439/63

FOREIGN PATENT DOCUMENTS

TW M286486 1/2006

* cited by examiner

*Primary Examiner*—James Harvey
(74) *Attorney, Agent, or Firm*—Wei Te Chung

(57) ABSTRACT

An RF connector assembly (100) for being mounted on a printed circuit board includes a coaxial cable (20) having a central contact (21), a coaxial connector (11), an insulative member (12) and an inner conductor (13) having a contacting portion (131). The coaxial connector has a main body (111), a tubular portion (118) extending horizontally from the main body, an axial bore (113) extending through the main body and the tubular portion for receiving the insulative member, a connecting member (112) extending from the main body and having at least one post (211) for engaging with the printed circuit board. The connecting member, the main body and the tubular portion are integrally formed as a whole.

8 Claims, 3 Drawing Sheets

RF CONNECTOR ASSEMBLY HAVING IMPROVED CONNECTING MEMBER

BACKGROUND OF THE INVENTION

1. Field of the Invention

The present invention relates to a RF (Radio Frequency) connector assembly, and more particularly to a RF connector assembly having an improved connecting member for mating with a printed circuit board.

2. Description of the Prior Art

An RF cable connector assembly is used for connecting a cable with an electronic device for transmitting RF signal. A TW Pat. No. M286486 issued on Jan. 21, 2006 discloses a RF connector assembly mounted to a printed circuit board. The RF connector assembly comprises a coaxial connector, a coaxial cable engaging with the coaxial connector and a connecting member mounted to the coaxial connector. The coaxial connector has a protruding portion extending downwardly from a bottom face of the coaxial connector for mating with the connecting member. The connecting member has four posts extending downwardly for engaging with corresponding holes defined on the printed circuit board.

During assembly, firstly, the protruding portion of the coaxial connector engages with the connecting member and then the connecting member is connected to the printed circuit board. That would result in complicating the assembly of the RF connector assembly to the printed circuit board and increasing the cost of manufacturing the RF connector assembly. Additionally, the engagement between the coaxial connector and the printed circuit board is unreliable.

Hence, an improved RF connector assembly is needed to solve the above problem.

BRIEF SUMMARY OF THE INVENTION

Object of the present invention is to provide a RF connector assembly having a reliable engagement between a coaxial connector and a printed circuit board. Another object of the present invention is to easily produce the RF connector assembly.

The present invention provides a RF connector assembly for being mounted on a printed circuit board comprising a coaxial cable including a central contact, an coaxial connector, an insulative member having an axial hollow defined therein and an inner conductor having a contacting portion received in the axial hollow. The coaxial connector comprises a main body, a tubular portion extending horizontally from the main body, an axial bore extending through the main a body and the tubular portion for receiving the insulative member, a connecting member extending from the main body and having at least one post for engaging with the printed circuit board. The coaxial connector integrates the main body, the tubular portion and the connecting member together as a whole.

Advantages of the present invention are to provide a coaxial connector comprising a main body, a tubular portion extending horizontally from the main body and a connecting member extending downwardly from the main body for assembling to a printed circuit board. The coaxial connector integrates the main body, the tubular portion and the connecting member together for strengthening the engagement between the coaxial connector and printed circuit board and to ease the assembly of the RF connector assembly.

Other objects, advantages and novel features of the invention will become more apparent from the following detailed description of the present embodiments when taken in conjunction with the accompanying drawings.

DETAILED DESCRIPTION OF THE INVENTION

Figure 1:
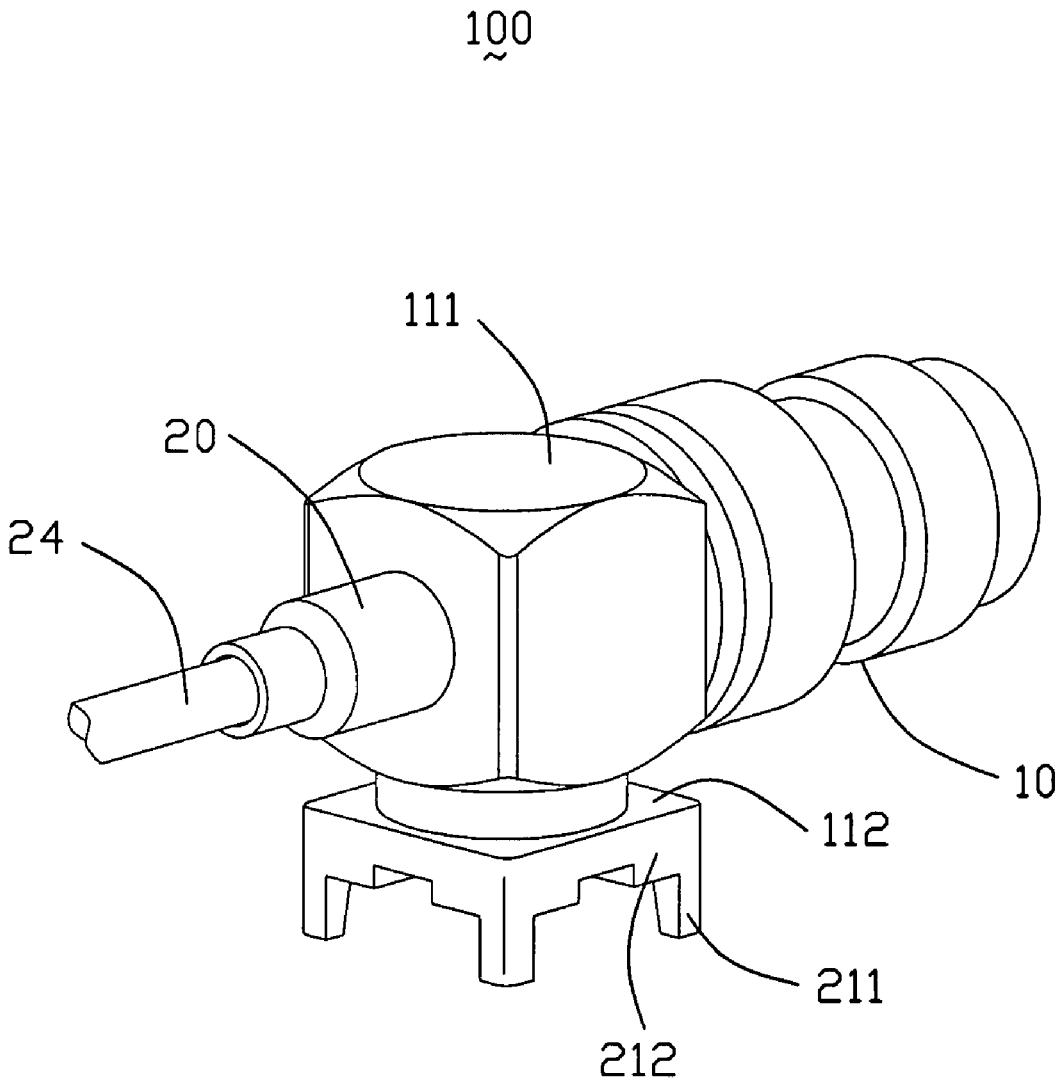
FIG. 1 is an assembled perspective view of a RF connector assembly.
Figure 2:
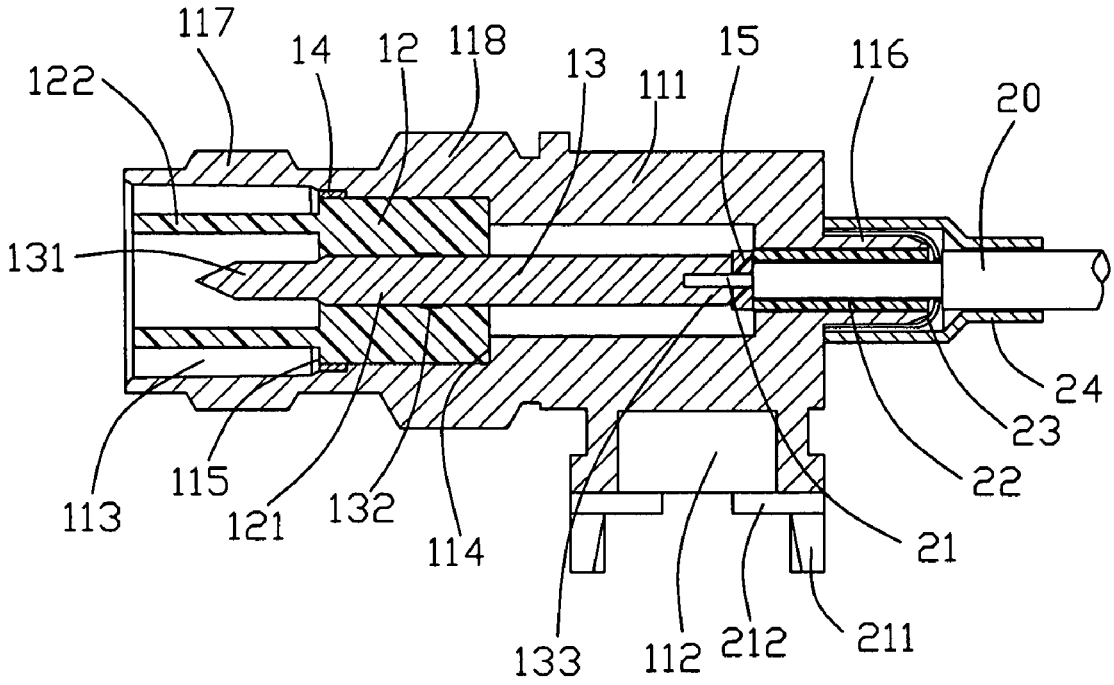
FIG. 2 is a cross-sectional view of the RF connector assembly as shown in FIG. 1.
Figure 3:
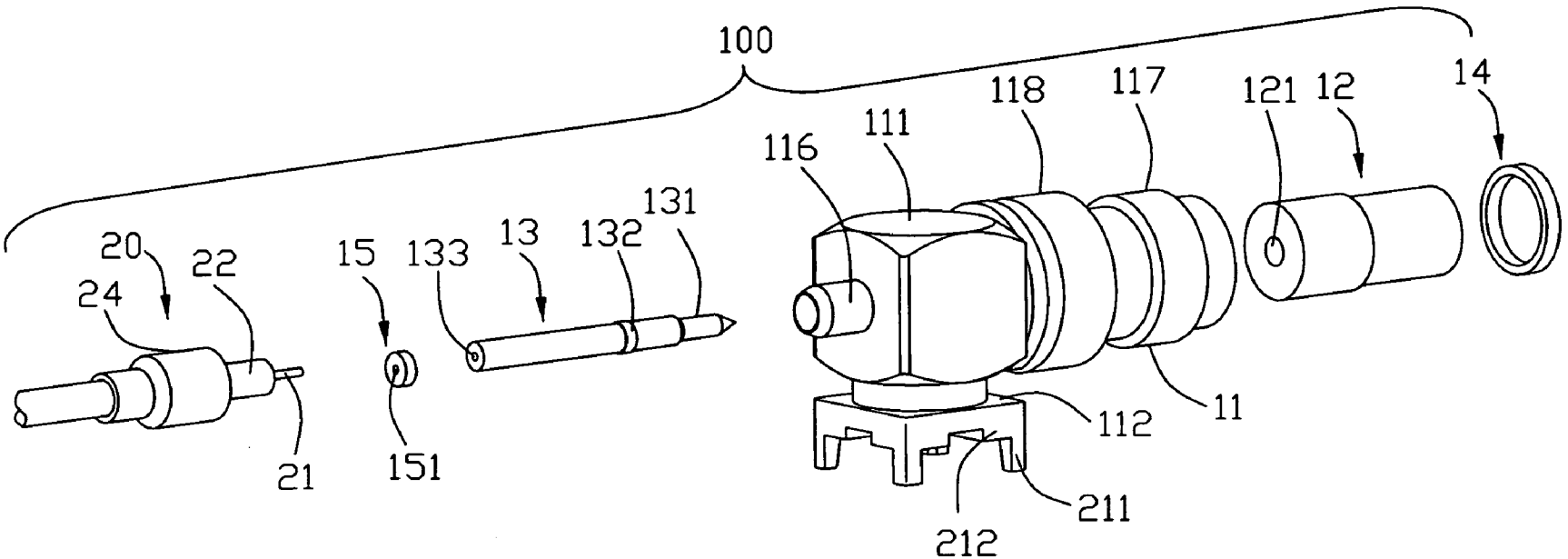
FIG. 3 is an exploded view of the RF connector assembly as shown in FIG. 1.

Reference will now be made to the drawing figures to describe the present invention in detail. Referring to FIGS. 1-3, a RF connector assembly 100 for being mounted on a printed circuit board (not shown) comprises a coaxial connector 11 and a coaxial cable 20 mounted to a rear portion of the coaxial connector 11. The RF connector assembly 100 further comprises an insulative member 12, an inner conductor 13, a clamping ring 14 for fastening the insulative member 12 to the outer connector 11, and an insulative patch 15 having a hole 151 defined on a core portion of the insulative patch 15 for engaging with the coaxial cable 20.

The coaxial connector 11 includes a main body 111, a connecting member 112 extending downwardly from the main body 111 for engaging with the printed circuit board, a tubular portion 118 extending forwardly from a front face of the main body 111 and an axial bore 113 extending though the main body 111 and the tubular portion 118 for receiving the insulative member 12. The tubular portion 118 further comprises a first protruding portion 114 extending inwardly and surrounding the axial bore 113 for resisting against a rear face of the insulative member 12 and a second protruding portion 115 for resisting against the clamping ring 14. The insulative member 12 is firmly received in the axial bore 113 of the coaxial connector 11 by snap interfering with the inner surface of the coaxial connector 11. The tubular portion 118 has circumferential ridges 117 for screwing into an internally-threaded portion of a corresponding plug (not shown). The coaxial connector 11 further comprises a tail tubule 116 extending rearwardly from the main body 111 for engaging with the coaxial cable 20.

The coaxial cable 20 comprises a retaining tubule 24 interfering with the tail tubule 116 and a mating portion 22 extending forwardly from the retaining tubule 24 and received in the tail tubule 116. In this manner, the coaxial cable 20 is firmly coupled with the tail tubule 116. The coaxial cable 20 further has a central contact 21 extending forwardly from the mating portion 22 and penetrating through the hole 151 of the insulative patch 15.

The RF connector assembly 100 integrates the main body 111, the tubular portion 118 and the connecting member 112 together as a whole. The connecting member 112 is perpendicular to the axial bore 13 of the coaxial connector 11. The connecting member 112 has a stepped portion 212 of rectangular configuration and four posts 211 extending downwardly from four corners of the stepped portion 212 for coupling with corresponding cavities (not shown) defined on the printed circuit board.

The inner conductor 13 has a contacting portion 131 received in an axial hollow 121 defined in the insulative member 12, a projecting rib 132 surrounding the inner conductor 13 for interfering with the insulative member 12.

Referring to FIGS. 1, 2 and 3, the RF connector assembly 100 of the present invention is assembled as follows.

Firstly, the insulative member 12 is inserted into the axial bore 113 and resists against corresponding first protruding portion 114. The clamping ring 14 surrounds the insulative member 12 and resists against the second protruding portion 115. At this time, the insulative member 12 is firmly received in the axial bore 113 of the coaxial connector 11.

Secondly, the central contact 21 of the coaxial cable 20 extends beyond the hole 151 of the insulative patch 15 and connects with the inner conductor 13.

Thirdly, the inner conductor 13 is inserted into the axial bore 113 of the coaxial connector 11. The projecting rib 132 of the inner conductor 13 interferes with the inner surface of the insulative member 12. At this time, the central contact 21 of the coaxial cable 20 has already been inserted into an axial passageway 133 defined in the inner conductor 13.

Finally, the four posts 211 of the connecting member 112 are mounted to the corresponding cavities of the printed circuit board.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A connector assembly for being mounted on a printed circuit board, comprising:

a coaxial connector comprising a main body, a tubular portion extending horizontally from the main body, an axial bore extending through the main body and the tubular portion, a connecting member having at least one post for engaging with the printed circuit board, wherein the main body, the tubular portion and the connecting member being integrally formed as a whole;

an insulative member received in the axial bore of the coaxial connector and having an axial hollow defined therein;

an inner conductor having a contacting portion received in the axial hollow and an axial passageway; and a coaxial cable having a central contact received in the axial passageway and electrically connecting to the inner conductor;

a clamping ring surrounding the insulative member and interfering with an inner surface of the tubular portion;

said tubular portion comprises a first protruding portion extending inwardly and surrounding the axial bore for resisting against a rear face of the insulative member and a second protruding portion for resisting against the clamping ring;

wherein said connecting member is perpendicular to the axial bore and comprises a stepped portion;

wherein the post extends downwardly from the stepped portion;

wherein said coaxial connector comprises a tail tubule extending rearwardly from a rear face of the main body for coupling with the coaxial cable;

wherein said inner conductor has a projecting rib surrounding thereon for interfering with the inner surface of the axial hollow of the insulative member;

wherein an insulative patch defining a hole in a core portion thereof for engaging with the central contact of the coaxial cable.

2. A connector assembly comprising:

a diecast metallic housing;

a tubular insulative housing retainably received in the metallic housing;

a conductive contact receiving in the insulative housing;

a tubule being unitarily formed at and extending rearward from a rear face of the metallic housing; and an insulative patch received in a rear face of the metallic housing and defining a through hole aligned with and received within the tubule;

a coaxial cable including an inner conductor having a front end mechanically and electrically connected to the contact, an inner insulator enclosing said inner conductor and enclosed in said insulative patch, and an outer conductor applied upon an outer surface of the tubule; wherein said outer conductor is radially sandwiched between the tubule and a retaining tube which further crimps an outer insulator of the cable under a condition that the outer insulator encloses said outer conductor.

3. The connector assembly as claimed in claim 2, wherein a front portion of the contact is radially isolated from the metallic housing by the insulative housing while a rear portion of the contact is radially exposed to but spaced from the metallic housing.

4. The connector assembly as claimed in claim 2, wherein said insulative patch defines a step structure on a front portion thereof, through which only the inner conductor extends forwardly, and thus said step structure axially separates the inner insulator and said contact.

5. The connector assembly as claimed in claim 2, wherein said insulative patch defines a step structure on a front portion thereof, which abuts against the contact to keep said contact with axially a distance from the rear face of the metallic housing.

6. The connector assembly as claimed in claim 2, wherein said inner insulator is intimately and snugly received in the insulative patch.

7. A connector assembly comprising:

a diecast metallic housing;

a tubular insulative housing retainably received in the metallic housing;

a conductive contact receiving in the insulative housing;

a tubule being unitarily formed at and extending rearward from a rear face of the metallic housing; and an insulative patch received in a rear face of the metallic housing and defining a through hole aligned with and received within the tubule;

a coaxial cable including an inner conductor having a front end mechanically and electrically connected to the contact, an inner insulator enclosing said inner conductor and enclosed in said insulative patch, and an outer conductor applied upon an outer surface of the tubule; wherein said insulative patch defines a step structure on a front portion thereof, which not only abuts against the contact to keep said contact with axially a distance from the rear face of the metallic housing but also receives the inner conductor only so as to isolate said contact and the associated inner conductor from the metallic housing both radially and axially.

8. The connector assembly as claimed in claim 7, wherein said inner insulator is intimately and snugly received in the insulative patch.

* * * * *